United States Patent [19]

Datwyler

[11] 4,000,862

[45] Jan. 4, 1977

[54] WIRE-WRAP DEPTH CONTROL FOR HAND HELD WIRING GUN

[75] Inventor: George L. Datwyler, Salt Lake City, Utah

[73] Assignee: Sperry Rand Corporation, New York, N.Y.

[22] Filed: June 25, 1975

[21] Appl. No.: 590,229

[52] U.S. Cl. ..... 242/7.06; 242/7.09; 242/7.17

[51] Int. Cl.[2] ..... H01R 43/00

[58] Field of Search ..... 242/7.06, 7.17, 7.18, 242/7.09, 242, 33, 140, 408; 33/169 B, 165; 140/124; 144/136 C; 408/203, 202, 14; 74/531

[56] References Cited

UNITED STATES PATENTS

| | | | |
|---|---|---|---|
| 1,943,638 | 1/1934 | Swanson | 33/165 |
| 3,066,879 | 12/1962 | Emberson et al. | 242/7.06 |
| 3,332,632 | 7/1967 | Johnston, Jr. | 242/7.06 |

*Primary Examiner*—Billy S. Taylor
*Attorney, Agent, or Firm*—Kenneth T. Grace; Thomas J. Nikolai; Marshall M. Truex

[57] ABSTRACT

An apparatus for selectively establishing the depth at which a hand-held wiring gun will wrap stripped electrical wire about electrical-connector Wire-Wrap pins, which pins are mounted upon an electrical interconnecting back panel, is disclosed. The apparatus includes a collet that is affixed to the gun's fixed sleeve, through which sleeve the rotatable wrapping bit extends axially. A level gauge is axially, helically, rotatably affixed upon the collet by a leaf-spring compressed ball bearing that rides in and along a helical groove in the external cylindrical surface of the collet. The helical groove has three detents spaced therealong into which the ball bearing is compressively secured by the spring. The axial dimensions of the three detents from the front face of the level gauge, which front face is of sufficient frontal dimensions to rest upon the tops of adjacent pins, establishes the three selectable depths at which the wire may be wrapped about the pin.

2 Claims, 4 Drawing Figures

WIRE-WRAP DEPTH CONTROL FOR HAND HELD WIRING GUN

BACKGROUND OF THE INVENTION

In the past, the depth at which wires were wrapped about Wire-Wrap pins when using a hand-held wiring gun was largely determined by sight of the operator. However, when using large back panels of many small size Wire-Wrap pins it is often required to attach as many as three wires to the same Wire-Wrap pin. The attaching of such number of wires to the same Wire-Wrap pin requires a more precise method of predetermining the depths at which the respective wires may be secured to the Wire-Wrap pin. The depth control of the present invention provides this necessary control of the placement of the wires upon the Wire-Wrap pins.

SUMMARY OF THE INVENTION

The present invention is directed toward a combination of a tubular collet having a tubular level gauge that is rotatably mounted upon the external cylindrical surface of the collet. The level gauge has affixed thereto and extending through an opening in the internal cylindrical surface thereof a ball bearing that is leaf-spring compressively secured in an helical groove in the external cylindrical surface of the collet. The helical groove has a plurality of detents therein and spaced therealong. The spacings of the detents, as dimensioned axially from the front face of the collet, determine the axially dimensioned movements of the level gauge along and about the collet as the ball bearing follows the axial groove and comes to rest within the respective detents.

DESCRIPTION OF THE PREFERRED EMBODIMENT

Figure 1:
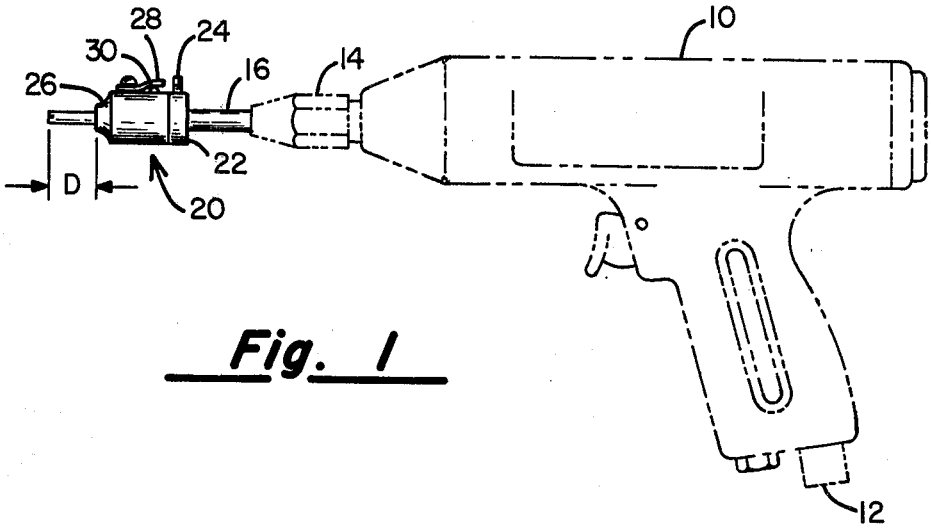
FIG. 1 is an illustration of a commercially available hand-held wiring gun with the depth control of the present invention assembled therewith.

With particular reference to FIG. 1 there is presented an illustration of a typical hand-held wiring gun upon which is assembled the apparatus of the present invention. The illustrated wiring gun is a Gardner-Denver air-powered Wire-Wrap tool Model No. 14YP1-37-C-30 that when coupled to a suitable source of air pressure at fitting 12 operates at a speed of 3700 RPM for attaching wire size (AWG) 30 to a suitable Wire-Wrap pin. Gun 10 comes provided with a suitable back force nose assembly 14 for securing sleeve 16 thereto while permitting a bit 18 to rotate freely therein.

The depth control 20 of the present invention includes a collet 22 that is affixed to the fixed sleeve 16 by means of a screw 24 through which fixed sleeve 16 the rotatable wrapping bit 18 extends axially. A level gauge 26 is axially, helically, rotatably affixed upon the collet 22 by a leafspring 28 compressed ball bearing 30 that rides in and follows along a helical groove 32 in the outside or external cylindrical surface of the collet 22.

Figure 2:
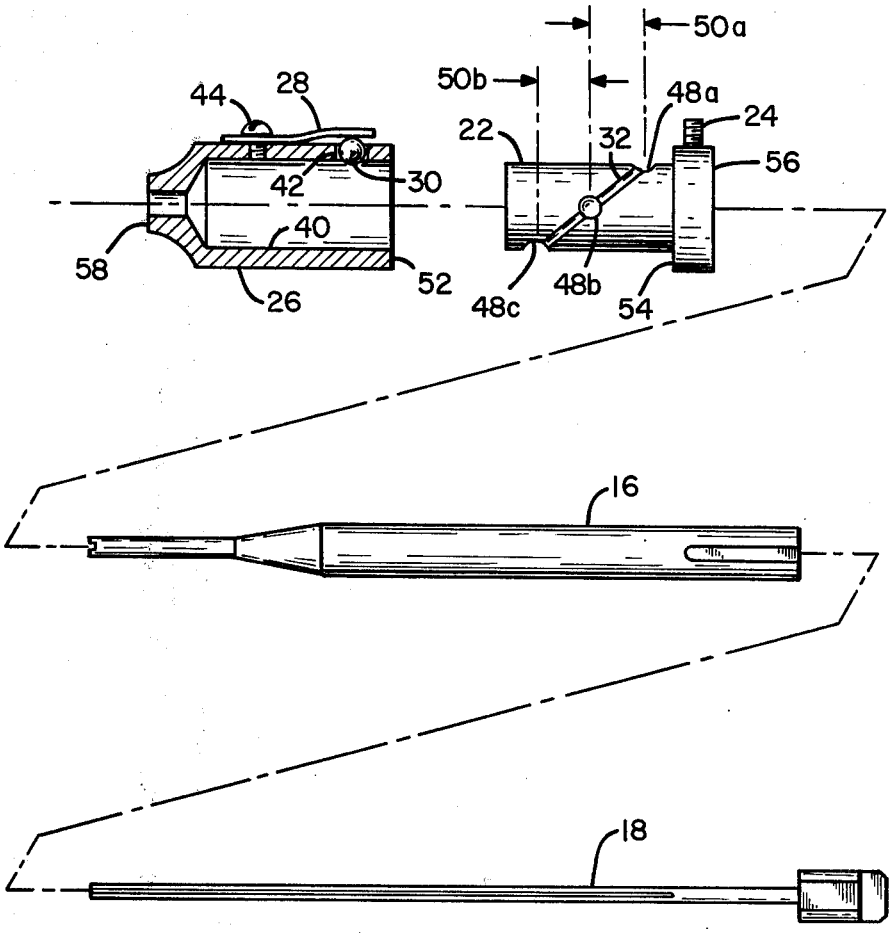
FIG. 2 is an exploded view of the depth control of the present invention illustrating its cooperative relationship with the sleeve provided with the gun of FIG. 1.

With particular reference to FIG. 2 there is presented an exploded view of the assembly of the depth control 20 upon the sleeve 16 and the bit 18 which is rotatably, axially aligned within the central axial opening of the sleeve 16 - both sleeve 16 and bit 18 are provided as part of the gun 10, and, accordingly, play no part in the present invention.

The level gauge 26 has affixed thereto and extending through the inside or internal cylindrical surface 40 of level gauge 26 a ball bearing 30 that is secured within a chamfered or countersunk opening 42 that passes through the tubular wall of level gauge 26 having a lower diameter smaller than that of the diameter of ball bearing 30 for holding ball bearing 30 in opening 42 in a compressively secured manner by leafspring 28 and machine screw 44. Collet 22 has a helical groove 32 in the outside cylindrical surface thereof which helical groove 32 has three detents 48*a*, 48*b*, 48*c* which are located in 90° radial increments about collet 22 and in equal axial dimensions 50*a*, 50*b* axially along the longitudinal axis of collet 22.

In assembling the depth control 20 of the present invention, machine screw 44 is loosened sufficiently to relieve the leaf-spring 28 pressure upon ball bearing 30 such that level gauge 26 freely slides upon the external cylindrical surface of collet 22 with the backface 52 of level gauge 26 coming into substantial contact with the front surface 54 of stop 56 of collet 22. Next, the ball bearing 30 is oriented in the general area of detent 48*a* while machine screw 44 is tightened sufficiently to assemble level gauge 26 upon collet 22 is a substantially fixed manner. Next, level gauge 26 is rotated in a clockwise manner, as viewed from the front end or surface 58 of level gauge 26 while machine screw 44 is adjusted to ensure that level gauge 26 is securely affixed to collet 22 while permitting ball bearing 30 to move along groove 32 and into and out of the detents 48*a*, 48*b*, 48*c* in a secure but hand rotatable, manageable manner.

With level gauge 26 securely mounted upon collet 22 in a secure but hand rotatable manner, and with the backface 52 of level gauge 26 substantially in contact with the front face 54 of stop 56 of collet 22, depth control 20 may now be secured to sleeve 16 by means of screw 24 at the desired dimension D from the front end of sleeve 16.

Figure 3:
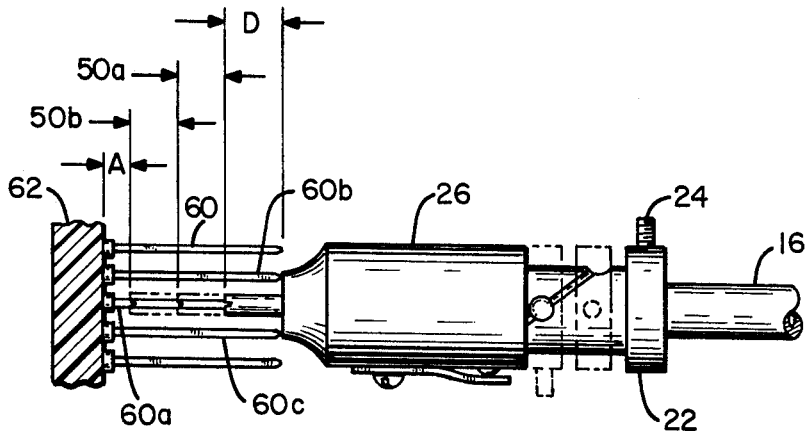
FIG. 3 is an illustrative example of the relative positioning of the depth control of the present invention upon a pattern of wire-wrap pins installed on a back panel.

With particular reference to FIG. 3 there is presented an illustration of the manner in which the dimension D is to be established. Of course, it is to be appreciated that the relative dimensions 50*a*, 50*b* between the detents 48*a*, 48*b*, 48*c* of collet 22 are dictated by the particular dimensions of the Wire-Wrap pin 60 with which gun 10 and depth control 20 are to be utilized. As an example, using a Wire-Wrap pin 60 of approximately 0.525 inch in length, as measured from the surface of insulative substrate member 62, upon which are to be wound three wires of wire size 30 AWG, the dimension A is approximately 0.047 inch while dimensions 50*a*, 50*b* are each of approximately 0.142 inch in length.

With a pin 60 spacing of 0.10 inch, centerline-to-centerline, and a front surface 58 of level gauge 26 of approximately 0.36 inch outside diameter, sleeve 16 and bit 18 are colinearly aligned with the pin 60*a*. With level gauge 26 assembled upon collet 22 in its rearmost position, such as with ball bearing 30 situated within detent 48*a*, and with screw 24 sufficiently loosened to permit the axial movement of depth control 20 along sleeve 16, the front end of sleeve 16 is set at a dimension D of, e.g., 0.194 inch. The front surface 58 of level gauge 26 is then brought into contact with the outwardly extending ends of pins 60*b* and 60*c* which are next adjacent to the pin 60*a* upon which sleeve 16 is assembled. At this time, then, screw 24 is secured against the outside surface of sleeve 16 for fixedly securing collet 22, and, accordingly, level gauge 26, upon sleeve 16, and establishing the now fixed dimensions D, 50*a*, 50*b* which determine the relative positions of the wires upon the pins 60.

Figure 4:
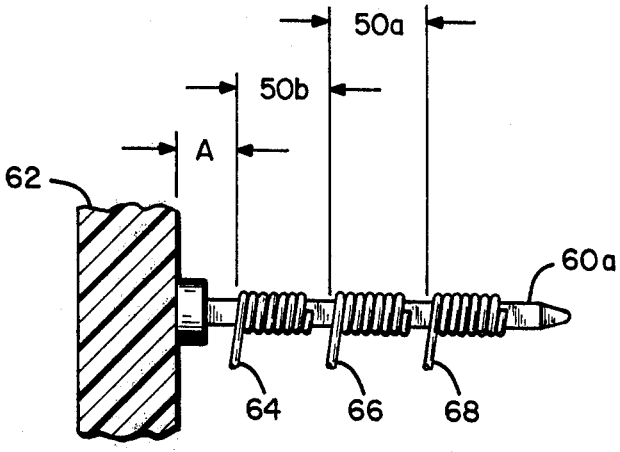
FIG. 4 is an illustrative example of the positioning of three wires wrapped about a wire-wrap pin according to the positioning configuration of FIG. 3.

With particular reference to FIG. 4 there is presented an illustration of the configuration of the three wires 64, 66, 68 upon the pin 60 that is affixed to insulative substrate member 62. The relative positions of such wires are predetermined by the respective positions of detents 48*a*, 48*b*, 48*c* which are machined within the helical groove 32 within the external cylindrical surface of collet 22.

What is claimed is:

1. A depth control for selectively establishing the depth at which a hand-held wiring gun, which gun has a back force nose assembly that secures a fixed sleeve through which a wire wrapping bit rotatively extends, will wrap stripped electrical wire about an electrical-connector, Wire-Wrap pin within a pattern of pins assembled upon an insulating substrate member, comprising:

a collet that is affixed to the fixed sleeve of said wiring gun, said collet including a first tubular member having a helical groove in the external cylindrical surface thereof and a plurality of detents within said groove and spaced along the longitudinal axis of said collet;

a level gauge including:

a second tubular member having an internal cylindrical surface for rotatably mounting about the external cylindrical surface of said collet;

a ball bearing positioned within an aperture in said second tubular member and extending through said internal cylindrical surface;

a leaf-spring compressively securing said ball bearing within said aperture and compressively securing said ball bearing within said helical groove for determining the axially directioned movement of said level gauge along and about said collet as said ball bearing follows said helical groove and comes to rest within a respective one of said detents.

2. A depth control for selectively establishing the depth at which a hand-held gun, which gun has a fixed nose assembly through which a wire wrapping bit rotatively extends, will wrap stripped electrical wire about an electrical-connector pin, comprising:

a collet that may be affixed to said wiring gun, said collet having a helical groove in an outer cylindrical surface thereof and a plurality of detents within said helical groove that are spaced along the longitudinal axis of said collet;

a level gauge including:

rotating means having an inside cylindrical surface for rotatively mounting about the outer cylindrical surface of said collet;

follower means for extending through said inside surface and into said helical groove;

means compressively securing said follower means upon said rotating means and within said helical groove for determining the axially directioned movement of said level gauge along said collet as said follower means follows said helical groove and comes to rest within a respective one of said detents.

* * * * *

UNITED STATES PATENT OFFICE

CERTIFICATE OF CORRECTION

PATENT NO. : 4,000,862

DATED : January 4, 1977

INVENTOR(S) : George L. Datwyler

It is certified that error appears in the above-identified patent and that said Letters Patent are hereby corrected as shown below:

Column 3, Line 29, "connector, Wire-Wrap" should be --connector Wire-Wrap--.

Column 4, Lines 1 - 14 should be three subparagraphs of the preceding major paragraph in Column 3, line 38.

Column 4, Line 16, "hand-held gun," should be --hand-held wiring gun,--.

Signed and Sealed this

Fifteenth Day of March 1977

[SEAL]

*Attest:*

RUTH C. MASON
*Attesting Officer*

C. MARSHALL DANN
*Commissioner of Patents and Trademarks*